US006837208B2

(12) United States Patent
Satou

(10) Patent No.: US 6,837,208 B2
(45) Date of Patent: Jan. 4, 2005

(54) CYLINDER BLOCK FOR INTERNAL COMBUSTION ENGINE

(75) Inventor: Naoyuki Satou, Tokyo (JP)

(73) Assignees: Nissan Motor Co., Ltd., Yokohama (JP); Renault s.a.s., Boulogne-Billancourt Cedex (FR)

( * ) Notice: Subject to any disclaimer, the term of this patent is extended or adjusted under 35 U.S.C. 154(b) by 0 days.

(21) Appl. No.: 10/303,705

(22) Filed: Nov. 26, 2002

(65) Prior Publication Data

US 2003/0098006 A1 May 29, 2003

(30) Foreign Application Priority Data

Nov. 27, 2001 (JP) ..... 2001-360176

(51) Int. Cl.[7] ..... F02F 7/00
(52) U.S. Cl. ..... 123/195 R
(58) Field of Search ..... 123/195 R, 196 R, 123/41.74, 193.2

(56) References Cited

U.S. PATENT DOCUMENTS 5,664,538 A * 9/1997 Hutchins ..... 123/195 R
5,727,512 A * 3/1998 Hutchins ..... 123/193.3

FOREIGN PATENT DOCUMENTS

JP 2000-213411 A 8/2000

* cited by examiner

*Primary Examiner*—Tony M. Argenbright
*Assistant Examiner*—Hyder Ali
(74) *Attorney, Agent, or Firm*—Foley & Lardner LLP

(57) ABSTRACT

A cylinder block for an automotive internal combustion engine. The cylinder block comprises a cylinder block side wall which includes a boss section located corresponding to a position between adjacent cylinders and is formed with an oil dropping passage through which lubricating oil to be returned to a crank case is introduced. In this cylinder block, the oil dropping passage is located adjacent the boss section and includes an upper passage portion, a lower passage portion, and an intermediate passage portion connecting the upper and lower passage portions. The cylinder block side wall includes an outer wall surrounding the intermediate passage portion of the oil dropping passage. The outer wall has an axially extending side section located at one side in an engine cylinder row direction. The axially extending side section linearly integrally connects the lower end of the boss section and the lower deck.

4 Claims, 4 Drawing Sheets

CYLINDER BLOCK FOR INTERNAL COMBUSTION ENGINE

BACKGROUND OF THE INVENTION

This invention relates to improvements in a cylinder block, more particularly to a structure of oil dropping passage formed in the cylinder block.

In an automotive internal combustion engine, a cylinder head is usually fastened to a cylinder block by screwing bolts into boss sections of the cylinder block in which each boss section is formed in a cylinder block side wall and located between adjacent cylinders. Additionally, oil dropping passages are formed in the cylinder block side wall to introduce lubricating oil to be returned to an oil pan. In case that the oil dropping passage is intended to be formed in the boss section formed with a bolt hole into which the bolt is screwed, it is necessary to form the boss section large. In this regard, it is general to form the oil dropping passage at a position separate from the boss section.

Additionally, Japanese Patent Provisional Publication No. 2000-213411 discloses a cylinder block formed with an oil dropping passage which has an upper end opened to an upper deck and a lower end opened to the upper side section of a crank chamber. The cross-sectional area of the oil dropping passage is varied in an axial direction of the passage. In other words, the lower section of the oil dropping passage is enlarged in cross-sectional area as compared with the upper section of the passage.

SUMMARY OF THE INVENTION

Concerning the above earlier technique in which the oil dropping passage is formed at the position separate from the boss section, it is required to form reinforcement ribs which linearly extend from the lower ends of the boss sections toward the lower deck of the cylinder block. Because, the fastening force of the above bolt is considerably large, and therefore there is a fear of deforming cylinder bores. Consequently, it is necessary to increase the rigidity of the boss section to prevent deformation of the cylinder bores. However, this measure will unavoidably increase the weight of the cylinder block.

Concerning the above conventional technique of Japanese Patent Provisional Publication No. 2000-213411, the lower end of the oil dropping passage in the cylinder block is formed to be opened to the upper side section of the crank chamber. As a result, lubricating oil dropped from the dropping passage into the crank chamber is unavoidably splashed up by a crank shaft so that air is mixed into lubricating oil thereby degrading a lubricating performance. Further, the oil dropping passage is formed linearly extending from the upper deck of the cylinder block toward the oil pan below the cylinder block, and therefore there is a fear that blow-by gas generated in the crank chamber is directly blown up to the cylinder head. This requires an oil separator which is a separate part from the cylinder head in order to separate lubricating oil from the blow-by gas.

An object of the present invention is to provide an improved cylinder block for an internal combustion engine, which can effectively overcome drawbacks encountered in cylinder block of conventional and earlier techniques.

Another object of the present invention is to provide an improved cylinder block for an internal combustion engine, in which the rigidity of boss sections can effectively increased while avoiding an increase in weight of the cylinder block.

A further object of the present invention is to provide an improved cylinder block for an internal combustion engine, in which cylinder bores can be effectively prevented from deformation without using of reinforcement ribs.

A still further object of the present invention is to provide an improved cylinder block for an internal combustion engine, in oil component in blow-by gas introduced through oil dropping passages can be effectively separated without providing an oil separator as a separate part.

An aspect of the present invention resides in a cylinder block for an internal combustion engine. The cylinder block comprises a cylinder block side wall including a boss section located corresponding to a position between adjacent cylinders. A cylinder head is fastened to the side wall at the boss section by a bolt. The cylinder block side wall further includes a section defining therein an oil dropping passage through which lubricating oil to be returned from the cylinder head to a crank case is introduced. In this cylinder block, the oil dropping passage is located adjacent the boss section and includes an upper passage portion whose upper end is opened to an upper deck of the cylinder block, a lower passage portion whose lower end is opened to a lower section of the cylinder block, and an intermediate passage portion through which the upper and lower passage portions are in communication with each other. The oil dropping passage defining section includes an outer wall surrounding the intermediate passage portion of the oil dropping passage. The outer wall has a side section located at one side in an engine cylinder row direction. The side section linearly integrally connects the lower end of the boss section and the lower deck.

DETAILED DESCRIPTION OF THE INVENTION

Figure 1:
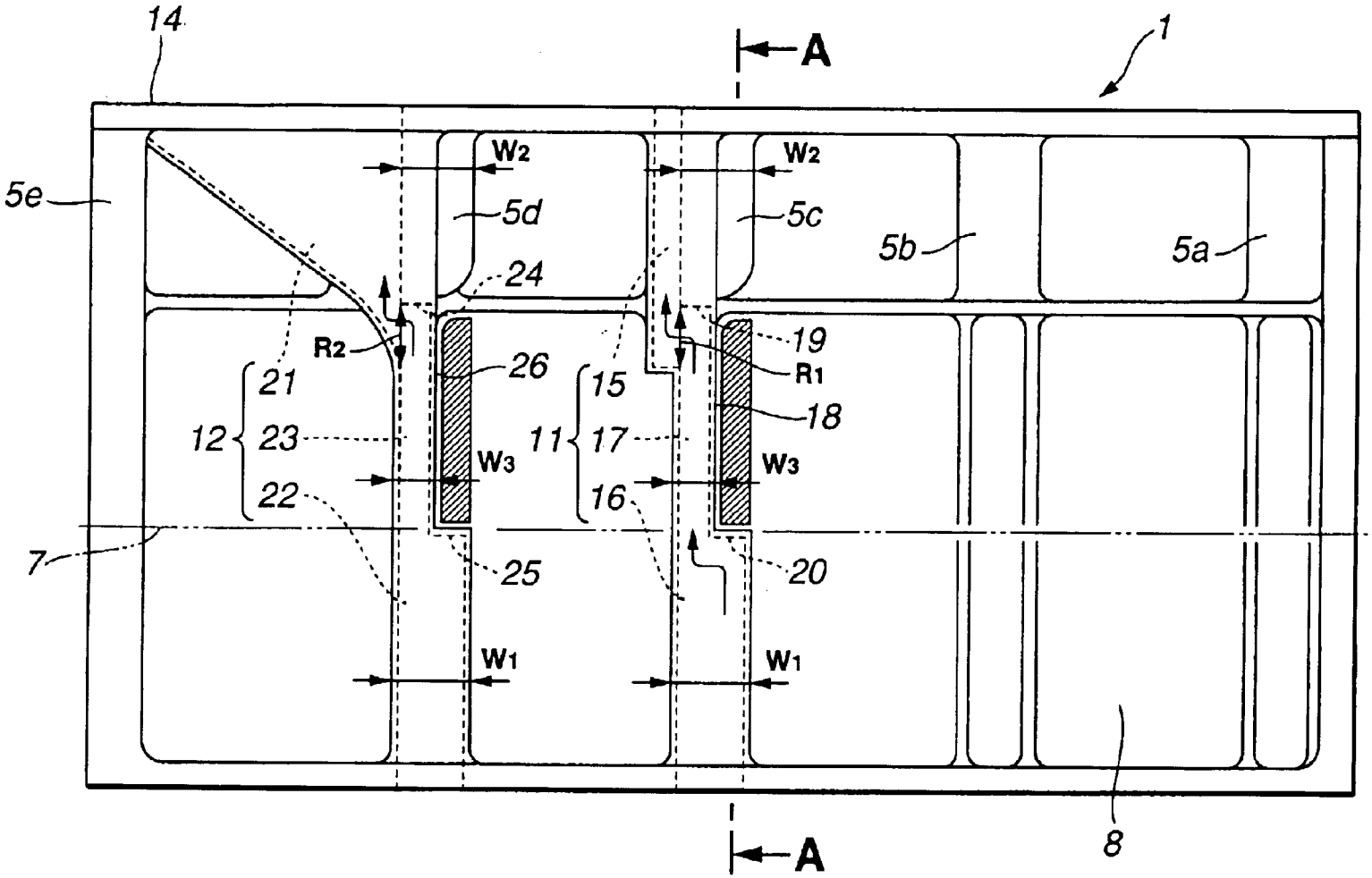
FIG. 1 is a side elevation of an embodiment of a cylinder block according to the present invention.
Figure 2:
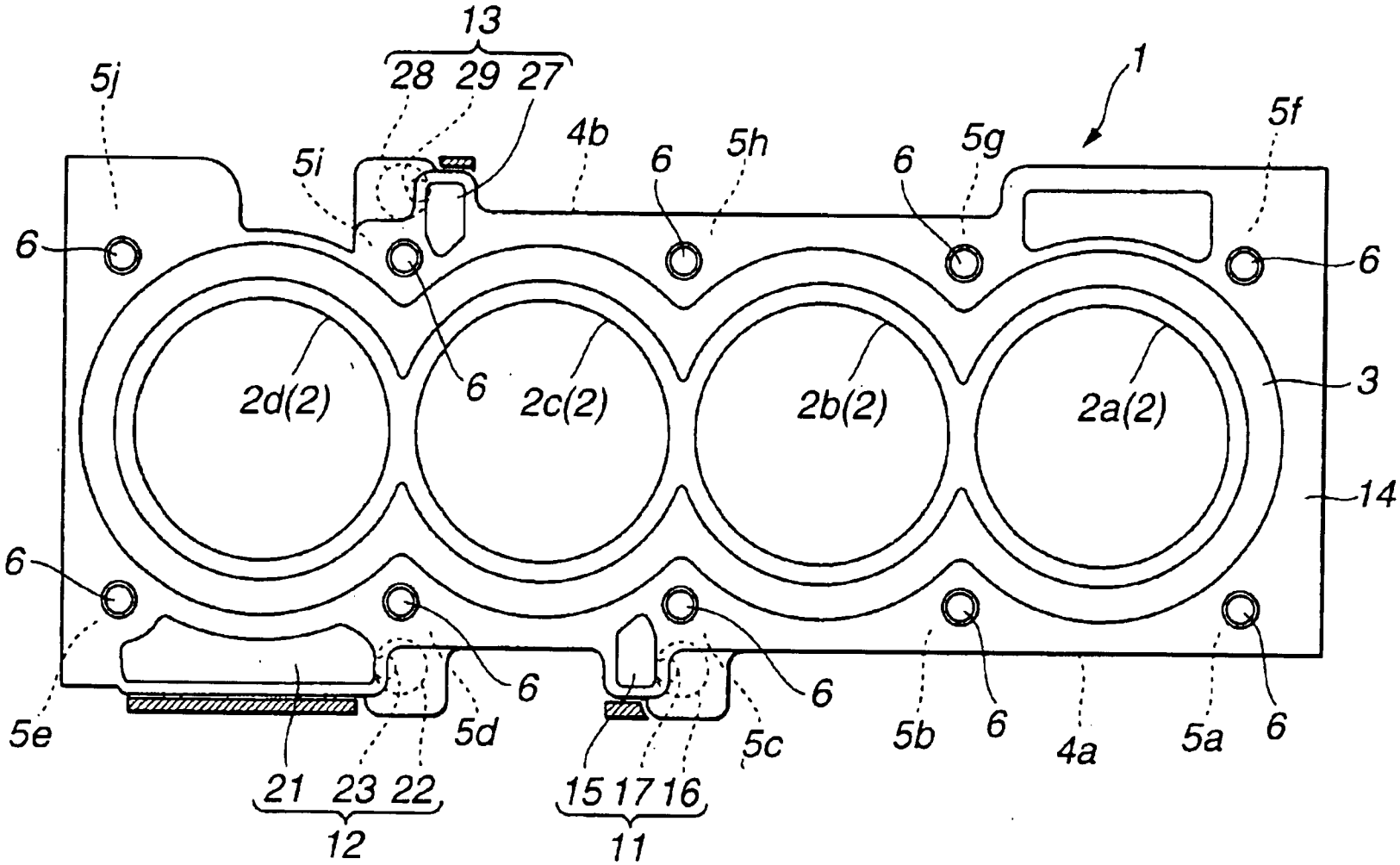
FIG. 2 is a plan view of the cylinder block of FIG. 1.
Figure 3:
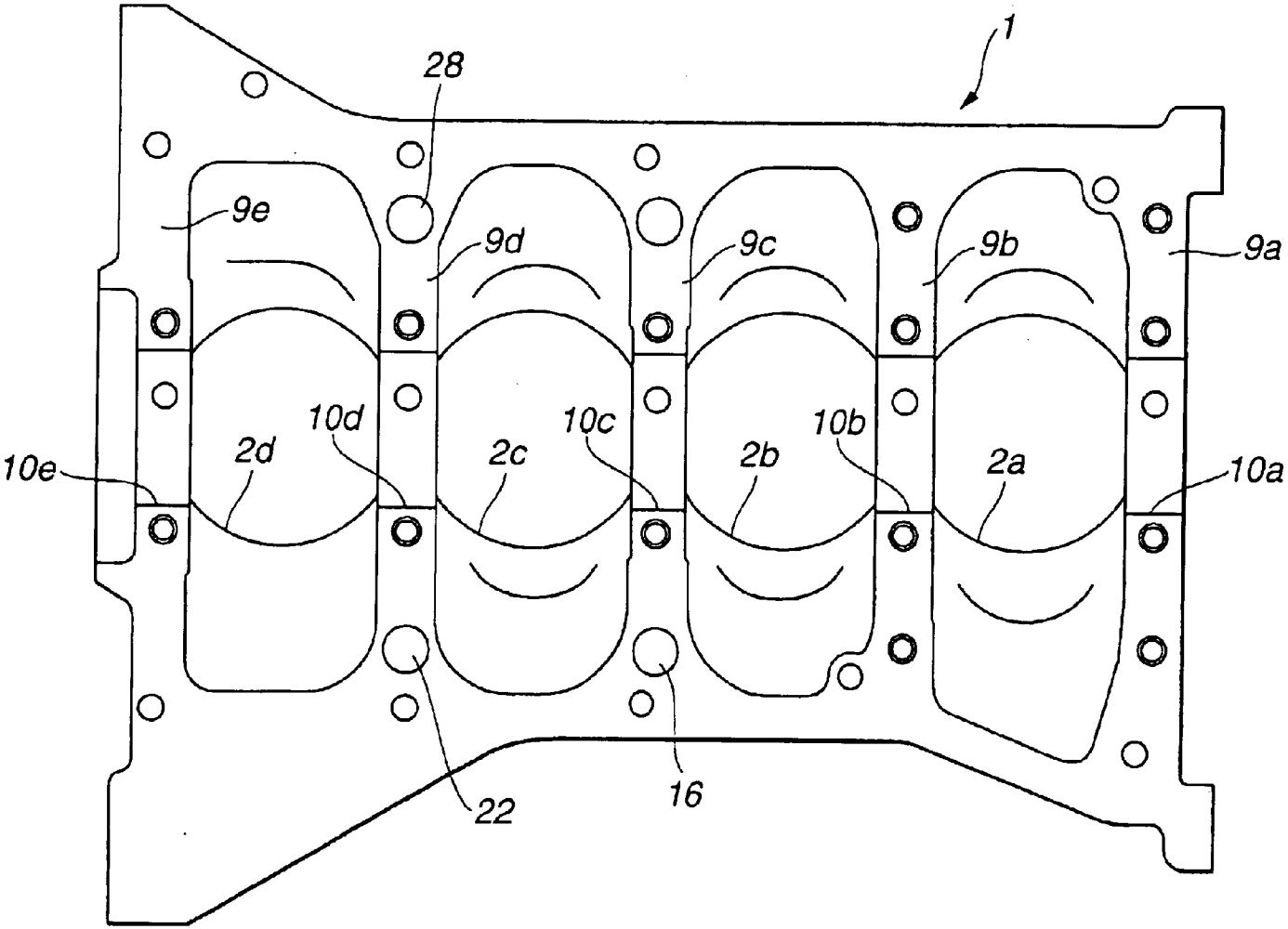
FIG. 3 is a bottom view of the cylinder block of FIG. 1.

Referring now to FIGS. 1 to 4 of the drawings, an embodiment of a cylinder block for an internal combustion engine, according to the present invention is designated by the reference numeral 1. Cylinder block 1 is of the inline four-cylinder type and is formed of, for example, aluminum alloy or cast iron. The cylinder block is produced integrally by casting. As shown in FIG. 2, cylinder block 1 has four cylinders 2 (2*a* to 2*d*) which are parallelly aligned in a fore-and-aft direction of the internal combustion engine. In other words, the axes of the four cylinders 2*a* to 2*d* are parallel and contained in an imaginary vertical plane extending in a vertical direction of the engine. Each cylinder 2 is defined inside a cylinder wall (not identified) which is formed integral with an adjacent cylinder wall (not identified) defining the adjacent cylinder. The cylinder walls are surrounded by a water jacket (engine coolant passage) 3. The right side end of cylinder block 1 in FIG. 2 corresponds to an front end of the engine so that first, second, third and fourth cylinders 2*a*, 2*b*, 2*c*, 2*d* are arranged in the fore-and-aft direction of the engine. Boss sections 5*a* to 5*e* are formed in a side wall 4*a* of the cylinder block. Boss sections 5*f* to 5*j* are formed in an opposite side wall 4*b* of the cylinder block. Each boss section 5*a* to 5*j* is formed with a bolt hole 6 in which a bolt (not shown) for fastening a cylinder head (not shown) to the cylinder block is inserted or screwed.

Cylinder block 1 has lower deck 7 from which skirt section 8 extends downward as shown in FIG. 1 to define a space (not shown) which forms an upper part of a crank chamber (not identified) inside a crankcase. Bulkheads 9*a* to 9*e* are disposed inside the skirt section to divide the inside of the skirt section into a plurality of small chambers each of which corresponds to each cylinder 2*a* to 2*d*. Bulkheads 9*a* to 9*e* are respectively formed with bearing sections 10*a* to 10*e* each of which is located at the central part of the bottom edge or surface of each bulkhead. Bearing sections 10*a* to 10*e* rotatably support the upper-half of a crankshaft (not shown).

Side wall 4*a* of the cylinder block is formed with oil dropping passages 11, 12. Side wall 4*b* is formed with an oil dropping passage 13. Lubricating oil to be returned from the cylinder head to an oil pan (not shown) flows through the oil-dropping passages 11 to 13. Oil dropping passage 11 is formed adjacent boss section 5*c* which is located corresponding to a position between second and third cylinders 2*b*, 2*c*. Oil-dropping passage 12 is formed adjacent boss section 5*d* which is located corresponding to a position between third and fourth cylinders 2*c*, 2*d*. Oil dropping passage 13 is formed adjacent boss section 5*i* which is located corresponding to a position between third and fourth cylinders 2*c*, 2*d*.

Figure 4:
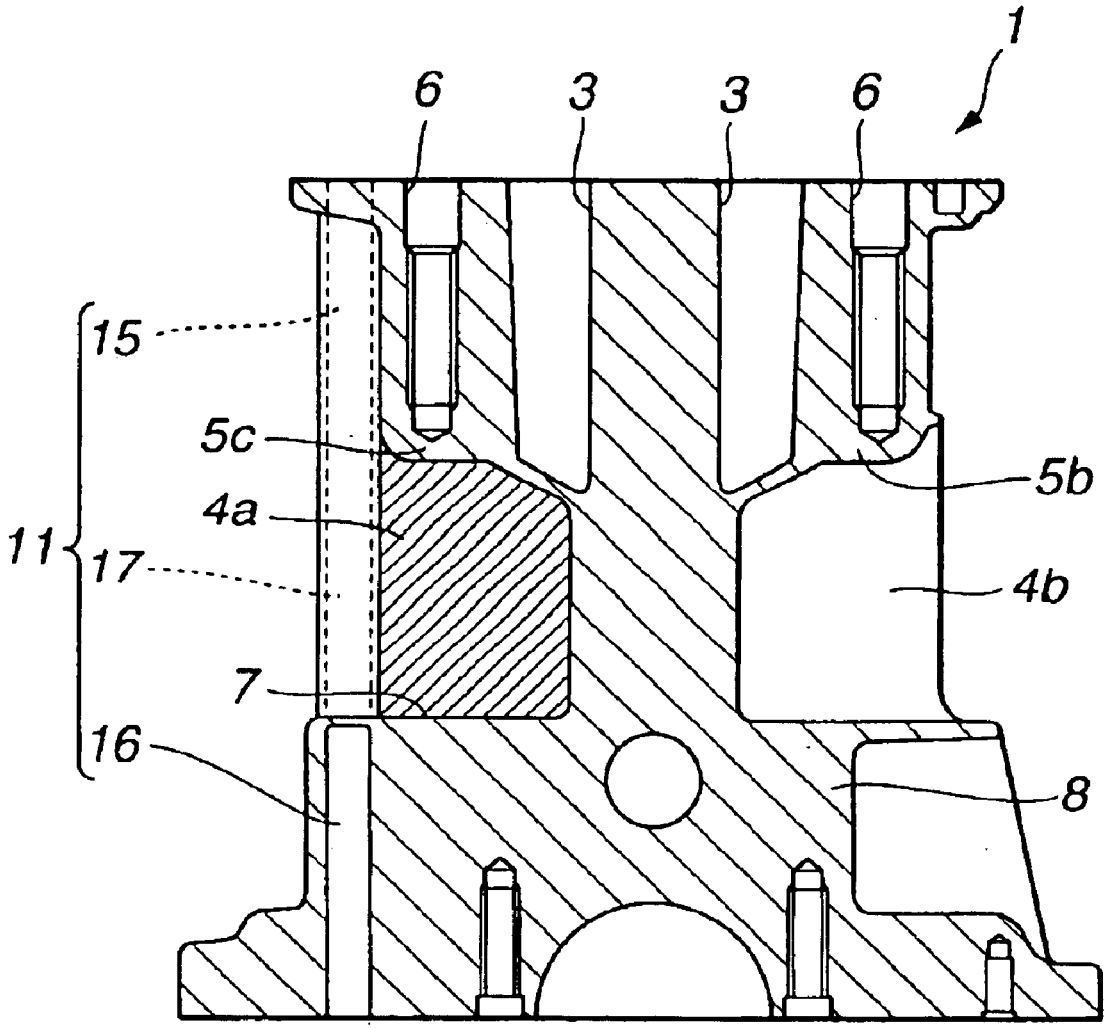
FIG. 4 is a cross-sectional view taken in the direction of arrows substantially along the line A—A of FIG. 1.

As shown in FIGS. 1, 2 and 4, oil dropping passage 11 includes upper passage portion 15 whose upper end is opened to an upper deck of cylinder block 1. Lower passage portion 16 of the oil dropping passage has its lower end which is opened to the lower section of cylinder block 1. The lower passage portion is circular in cross-section. Upper passage portion 15 and lower passage portion 16 are connected through intermediate passage portion 17 which is circular in cross-section, so that the upper and lower passage portions are in communication with each other. Upper passage portion 15 is formed in such a manner that its upper (open) end is adjacent boss section 5*c*. The upper passage portion has the same cross-sectional shape throughout its length.

Lower passage portion 16 is formed extending from lower deck 7 of cylinder block 1 and the bottom surface of cylinder block 1, and formed parallel with the axis of each cylinder 2*a* to 2*d*. The lower end of lower passage portion 16 is opened to the bottom surface of bulkhead 9*c*. Lower passage portion 16 has the same cross-sectional shape throughout its length. In other words, lower passage portion 16 includes an upper part which is formed in an outer wall of the skirt section 8 which outer wall forms part of side wall 4*a* of cylinder block, and a lower part which is formed through bulkhead 9*c* at a portion close to the outer wall of skirt section 8. Lower passage portion 16 is located below boss section 5*c* and formed such that its width W1 generally equals to a width W2 of boss section 5*c*. The widths W1 and W2 are in an engine cylinder row direction (in which cylinders 5 are aligned) or the fore-and-aft direction of the cylinder block. Lower passage portion 16 is formed offset relative to upper passage section 15 on the imaginary vertical plane containing the axes of four cylinders 2*a* to 2*d*.

Intermediate passage portion 17 is formed parallel with the axes of cylinders 2*a* to 2*d* and extends from boss section 5*c* to lower deck 7 of cylinder block 1. Intermediate passage portion 17 has the same cross-sectional shape throughout its length. More specifically, intermediate passage portion 17 has a width W3 which is generally ½ of the width W2 of boss section 5*c*. The width W3 is in the engine cylinder row direction. Intermediate passage portion 17 is surrounded by the cylinder block outer wall whose one side section 18 in the engine cylinder row direction is located corresponding to the central part of the boss section 5*c* in an engine cylinder row direction (in which cylinders 2 are aligned) or fore-and-aft direction of cylinder block 1. The side section 18 axially extends generally along the axis of each cylinder. The lower end of boss section 5*c* and lower deck 7 are linearly integrally connected with each other by this axially extending side section 18. Additionally, intermediate passage portion 17 is formed offset relative to upper passage portion 15 in the engine cylinder row direction, so that first step portion 19 is formed at the joint portion between upper and intermediate passage portions 15, 17. First step portion 19 extends in the engine cylinder row direction so as to form a flat inner surface of oil dropping passage 11 which flat inner surface is generally perpendicular to the axis of intermediate passage portion 17.

The lower end of intermediate passage portion 17 is connected to the upper end of lower passage portion 16. Second step portion 20 is formed at the joint portion between intermediate and lower passage portions 17, 16. In other words, intermediate passage section 17 is smaller in cross-sectional area than lower passage section 16 at the joint portion between the intermediate and lower passage portions, thus forming second step portion 20 at the joint portion between the intermediate and lower passage portions. Second step portion 20 extends in the engine cylinder row direction so as to form a flat inner surface of oil dropping passage 11 which flat inner surface is generally perpendicular to the axis of lower passage portion 16.

The lower end of upper passage portion 15 is located closer to cylinder block lower deck 7 than the lower end of boss section 5*c* (i.e., the upper end of intermediate passage section 17) so that the passage cross-sectional area of the joint portion between upper and intermediate passage portions 15, 17 takes a necessary and minimum value at which returning of lubricating oil to the oil pan cannot be prevented. The necessary and minimum value provides a vertical distance R1 as shown in FIG. 1.

Oil dropping passage 12 includes upper passage portion 21 whose upper end is opened to the upper deck of cylinder block 1. Lower passage portion 22 of the oil dropping passage has its lower end opened to the lower section of cylinder block 1. The lower passage portion is circular in cross-section. Upper passage portion 21 and lower passage portion 22 are connected through intermediate passage portion 23 which is circular in cross-section, so that the upper and lower passage portions are in communication with each other.

Intermediate and lower passage portions 23, 22 of oil dropping passage 12 are respectively generally the same in arrangement as those 17, 16 of the above-mentioned oil dropping passage 11. However, upper passage portion 21 of this oil dropping passage 12 is different in arrangement from that of oil dropping passage 11 so as to be formed generally flat funnel-shaped, in which its cross-sectional area increases in a direction of from the joint portion between it and intermediate passage portion 23 to upper deck 14 of cylinder block 1.

Intermediate passage portion 23 is surrounded by the cylinder block outer wall whose one side section 26 in the engine cylinder row direction is located corresponding to the central part of the boss section 5*d* in the engine cylinder row direction. The side section 26 axially extends generally along the axis of each cylinder. The lower end of boss section 5*d* and lower deck 7 are linearly integrally connected with each other by this axially extending side section 26. Additionally, intermediate passage portion 23 is formed offset relative to the upper passage portion 21 in the engine cylinder row direction, so that first step portion 24 is formed at the joint portion between upper and intermediate passage portions 21, 23. First step portion 24 extends in the engine cylinder row direction so as to form a flat inner surface of oil dropping passage 12 which flat inner surface is generally perpendicular to the axis of intermediate passage portion 23.

The lower end of intermediate passage portion 23 is connected to the upper end of lower passage portion 22. Second step portion 25 is formed at the joint portion of intermediate and lower passage portions 23, 22. In other words, intermediate passage section 23 is smaller in cross-sectional area than lower passage section 25 at the joint portion between the intermediate and lower passage portions, thus forming second step portion 25 at the joint location of the intermediate and lower passage portions. Second step portion 25 extends in the engine cylinder row direction so as to form a flat inner surface of oil dropping passage 12 which flat inner surface is generally perpendicular to the axis of lower passage portion 22. The lower end of upper passage portion 21 is located close to cylinder block lower deck 7 relative to the lower end of boss section 5*d* (i.e., the upper end of intermediate passage portion 23) so that the passage cross-sectional area of the joint portion between upper and intermediate passage portions 21, 23 takes a necessary and minimum value at which returning of lubricating oil to the oil pan cannot be prevented. The necessary and minimum value provides a vertical distance R2 as shown in FIG. 1.

Oil dropping passage 13 includes upper passage portion 27 whose upper end is opened to the upper deck of cylinder block 1. Lower passage portion 28 of the oil dropping passage is circular in cross-section and has its lower end opened to the lower end of cylinder block 1. Upper passage portion 27 and lower passage portion 28 are connected through intermediate passage portion 29 which is circular in cross-section, so that the upper and lower passage portions are in communication with each other. This oil dropping passage 13 is generally the same in arrangement as that of the above-discussed oil dropping passage 11, in which first step portion (not shown) corresponding to first step portion 24 of oil dropping passage 11 is formed at the joint portion between upper and intermediate passage portions 27, 29 while second step portion (not shown) corresponding to second step portion 25 of oil dropping passage 11 is formed at the joint portion between intermediate and lower passage portions 29, 28.

Additionally, similarly to the above-discussed oil dropping passage 11, intermediate passage portion 29 is surrounded by the cylinder block outer wall whose one side section (not shown) is located corresponding to the central part of the boss section 5*i* in the engine cylinder row direction. The side section axially extends generally along the axis of each cylinder. The lower end of boss section 5*i* and lower deck 7 are linearly integrally connected with each other by this one side section.

In cylinder block 1 arranged as discussed above, each of intermediate passage portions 17, 23, 29 is located between each of boss sections 5*c*, 5*d*, 5*i* and the lower deck. The side section of the outer wall defining each intermediate passage portion 17, 23, 29 serves as a reinforcement member. Therefore, the rigidity of boss section 5*c*, 5*d*, 5*i* is increased without increasing the weight of cylinder block 1 as compared with a case where a reinforcement rib is formed at the lower end of boss section 5*c*, 5*d*, 5*i*. Particularly, axially extending side section (in the engine cylinder row direction) 18, 26 or the like of the outer wall surrounding each of intermediate passage portions 17, 23, 29 is located corresponding to the central part of each of boss sections 5*c*, 5*d*, 5*i* though the axially extending side section of the outer wall surrounding intermediate passage portion 29 is not shown. Each of these axially extending side sections 18, 26 or the like linearly integrally connect the lower end of each of boss sections 5*c*, 5*d*, 5*i* and lower deck 7. As a result, the rigidity of boss sections 5*c*, 5*d*, 5*i* can be effectively improved while effectively achieving weight lightening of cylinder block 1. Because, it becomes unnecessary to form a reinforcement rib at the lower end of each of boss sections 5*c*, 5*d*, 5*i* while it becomes possible to remove useless (cast) metal parts 5*c*, 5*d*, 5*i* indicated by oblique lines in FIGS. 1 and 4. Additionally, upper passage portions 15, 21, 27 are respectively formed adjacent boss sections 5*c*, 5*d*, 5*i*, and therefore useless (cast) metal parts indicated by oblique lines in FIG. 2 can be removed.

Since the lower ends of the lower passage portions 16, 22, 28 are opened respectively to the bottom surfaces of bulk heads 9*c*, 9*d*, lubricating oil from the open lower end of each lower passage portion 16, 22, 28 into the crank case drops to the vicinity of the oil pan without striking against the wall surface of the crank case. Accordingly, the dropped lubricating oil cannot be splashed up by the crank shaft, thereby preventing air from being mixed into the lubricating oil.

Each of oil dropping passages 11, 12 has first step portion 19, 24, and second step portion 20, 25 so as to be generally crank-shaped as a whole. Accordingly, blow-by gas generated in the crankcase strikes against the first and second step portions so that liquid or oil component is separated from the blow-by gas. As a result, it becomes unnecessary to provide an oil separator in each of oil dropping passages 11, 12, thus achieving cost reduction for cylinder block 1. Similarly, oil dropping passage 13 has the first and second step portions and generally crank-shaped as a whole, and therefore it becomes unnecessary to provide an oil separator therein.

Additionally, in the oil dropping passage 12, upper passage portion 21 is generally flat funnel-shaped so as to smoothly collect lubricating oil returned from the cylinder head, thus making it possible to allow lubricating oil to drop to the oil pan very rapidly.

As appreciated from the above, according to the present invention, the following significant advantages can be obtained: The boss sections of the cylinder block require a high rigidity in order to prevent cylinder bores from deformation under a high fastening pressure of bolts for fastening the cylinder head to the cylinder block. In this regard, a reinforcement rib has been connected to the lower end of the boss in earlier techniques. However, the boss section of the cylinder block according to the present invention is rigidly supported by the side section of the outer wall surrounding the intermediate passage portion of the oil dropping passage, and therefore the rigidity of the boss section can be improved without providing the reinforcement rib. Additionally, since the intermediate passage portion of the oil dropping passage is located between the boss section and the lower deck of the cylinder block, the rigidity of the boss section can be improved without increasing the weight of the cylinder block as compared with the earlier techniques where the reinforcement rib is formed at the lower end of the boss section.

The entire contents of Japanese Patent Application P2001-360176 (filed Nov. 27, 2001) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A cylinder block for an internal combustion engine, comprising:

a cylinder block side wall including a boss section located corresponding to a position between adjacent cylinders, a cylinder head being fastened to the side wall at the boss section by a bolt, and a section defining therein an oil dropping passage through which lubricating oil to be returned from the cylinder head to a crank case is introduced, wherein the oil dropping passage is located adjacent the boss section and includes an upper passage portion whose upper end is opened to an upper deck of the cylinder block, a lower passage portion whose lower end is opened to a lower section of the cylinder block, and an intermediate passage portion through which the upper and lower passage portions are in communication with each other, the oil dropping passage defining section including an outer wall surrounding the intermediate passage portion of the oil dropping passage, the outer wall having a side section located at one side in an engine cylinder row direction, the side section linearly integrally connecting the lower end of the boss section and the lower decks, wherein the upper and intermediate passage portions of the oil dropping passage are offset relative to each other in the engine cylinder row direction, a first step portion being formed at a joint portion between the upper and intermediate passage portions.

2. A cylinder block as claimed in claim 1, wherein the upper and lower passage portions are offset relative to each other in the engine cylinder row direction, the lower end of the lower passage portion being opened to a bottom surface of a bulk head of the cylinder block.

3. A cylinder block as claimed in claim 1, wherein the lower end of the intermediate passage portion is connected to the upper end of the lower passage portion, the intermediate passage portion being formed smaller in cross-sectional area than the lower passage portion at a joint portion between the intermediate and lower passage portions, a second step portion being formed at a joint portion between the intermediate and lower passage portions.

4. A cylinder block for an internal combustion engine, comprising:

a cylinder block side wall including a boss section located corresponding to a position between adjacent cylinders, a cylinder head being fastened to the side wall at the boss section by a bolt, and a section defining therein an oil dropping passage through which lubricating oil to be returned from the cylinder head to a crank case is introduced, wherein the oil dropping passage is located adjacent the boss section and includes an upper passage portion whose upper end is opened to an upper deck of the cylinder block, a lower passage portion whose lower end is opened to a lower section of the cylinder block, and an intermediate passage portion through which the upper and lower passage portions are in communication with each other, the oil dropping passage defining section including an outer wall surrounding the intermediate passage portion of the oil dropping passage, the outer wall having a side section located at one side in an engine cylinder row direction, the side section linearly integrally connecting the lower end of the boss section and the lower deck, wherein the upper passage portion has a cross-sectional area which increases in a direction toward the upper deck of the cylinder block from a joint portion between the upper and intermediate passage portions, the upper passage portion being formed generally flat funnel-shaped and extends in the engine cylinder row direction.

* * * * *